US006136400A

United States Patent [19]

Katayose et al.

[11] Patent Number: 6,136,400

[45] Date of Patent: Oct. 24, 2000

[54] PAPERCRAFT SHEET FOR FABRICATING A TOY

[75] Inventors: Satoshi Katayose; Ryo Usami, both of Tokyo-To, Japan

[73] Assignee: Shogakukan Inc., Tokyo-To, Japan

[21] Appl. No.: 09/094,112

[22] Filed: Jun. 9, 1998

[30] Foreign Application Priority Data

Nov. 10, 1997 [JP] Japan ..... 9-009871

[51] Int. Cl.[7] ..... B32B 3/02

[52] U.S. Cl. ..... 428/42.1; 428/40.1; 428/41.7; 428/42.2; 428/542.8; 446/98; 446/388

[58] Field of Search ..... 428/41.7, 40.1, 428/42.1, 42.2, 542.8, 12; 446/98, 388

[56] References Cited

U.S. PATENT DOCUMENTS 1,057,019 3/1913 Waddington ..... 446/388

2,079,550 5/1937 Mott ..... 446/98

2,935,238 5/1960 Koehler ..... 428/542.8

*Primary Examiner*—Nasser Ahmad

*Attorney, Agent, or Firm*—Ladas & Parry

[57] ABSTRACT

On one surface of a normal paper sheet 1, patterns 2 are printed, and tabs 3 for sticking are printed at the outside portions of the outlines of the patterns 2. On the reverse sides of the patterns 2, sticky surfaces 4 are provided at corresponding portions to which the tabs 3 for sticking are to be stuck. On the side having sticky surfaces 4 are provided a release sheet 6 whose size is substantially the same as the paper sheet 1. Lines 7 for clipping are provided along the outlines of the patterns 2 and the tabs 3 for sticking. Lines 8 and 9 for folding are provided in an inside area of the lines for clipping. The patterns 2 and the tabs 3 for sticking are clipped along the lines 7 for clipping. The clipped patterns are fabricated into a three-dimensional toy by folding along the lines for folding. Then the tabs 3 for sticking are fixedly stuck to the sticky surfaces 4 which are on the reverse sides of the patterns 2.

7 Claims, 3 Drawing Sheets

PAPERCRAFT SHEET FOR FABRICATING A TOY

FIELD OF THE INVENTION

This invention relates to a papercraft sheet for fabricating a toy, in particular, a papercraft sheet for fabricating a toy intended to shorten the fabrication time and to simplify the fabricating operation.

BACKGROUND OF THE INVENTION

There are conventional papercraft sheets for fabricating a toy, which comprise a paper sheet, patterns printed on the paper sheet, and tabs provided at portions along the contour of the patterns to be clipped or cut out. They can be fixedly fabricated into a three-dimensional toy by pasting the tabs to corresponding portions. They are mainly sold as single goods or as supplements to magazines and so on.

The above conventional papercraft sheets for fabricating a toy are usually cardboard or pasteboard which is only ready to be clipped or cut out along the outlines of the pattern.

However, the cardboard or the pasteboard which is only ready to be clipped along the outlines of the pattern has some problems. One of the problems is that when fabricating it, users soil their hands by pasting the tabs. Another of the problems is that if there are many tabs, it takes much time for the users to paste and fix. Therefore it is difficult for infants to fabricate the conventional papercraft sheets.

On the other hand, if the paper sheet which is ready to be clipped along the outlines of the pattern is a normal sheet, the pattern and the tabs for sticking may be printed on the front side of the normal sheet, the reverse side of the normal sheet may be entirely formed into a sticky surface and a release sheet having the same size as the normal sheet may be stuck to the sticky surface. In this case, the fabrication would be made by clipping the pattern along the outlines of the pattern, folding the clipped pattern sheet and then fixedly fabricating the pattern sheet into a three-dimensional product by sticking the tabs to corresponding portions of the sticky surface.

In fabricating the three-dimensional product as above, the whole reverse side of the normal sheet is formed into a sticky surface, and therefore the sticky surface may stick to the user's hands when the release sheet is separated from the normal sheet, especially in a case where the pattern has a complex configuration. Therefore it may be difficult to stick the tabs to the correct corresponding portions of the sticky surface and the pattern sheet may tend to be folded undesirably. Consequently, the finished condition of the fabricated product may be unsatisfactory.

SUMMARY OF THE INVENTION

The object of this invention is to provide a papercraft sheet for fabricating a toy which can be fabricated in a good finished condition by solving the above problems. The solution is that the tabs have no sticky surfaces, but sticky surfaces are provided at only necessary portions on the reverse surface of the pattern.

To achieve the above object, the papercraft sheet for fabricating a toy according to this invention, comprises;

a sheet having a front surface and a reverse surface, a pattern printed at a portion on the front surface of the sheet;

a tab for sticking, printed at an outside portion of an outline of the pattern on the front surface of the sheet;

a sticky surface provided on a reverse side of the pattern at a corresponding local portion to which the tab for sticking is to be stuck;

a release sheet stuck to the sticky surface and having a size substantially the same as said sheet;

a line for clipping provided at an outline of the pattern and the tab for sticking; and a line for folding provided in an inside area of the line for clipping;

wherein the pattern and the tab for sticking are clipped along the line for clipping, the paper craftsheet is fabricated into a three-demensional toy by folding along the line for folding, and the tab for sticking is fixedly stuck on the sticky surface.

BEST MODE FOR CARRYING OUT THE INVENTION

The invention will now be described in more detail with reference to the accompanying drawings.

Figure 1:
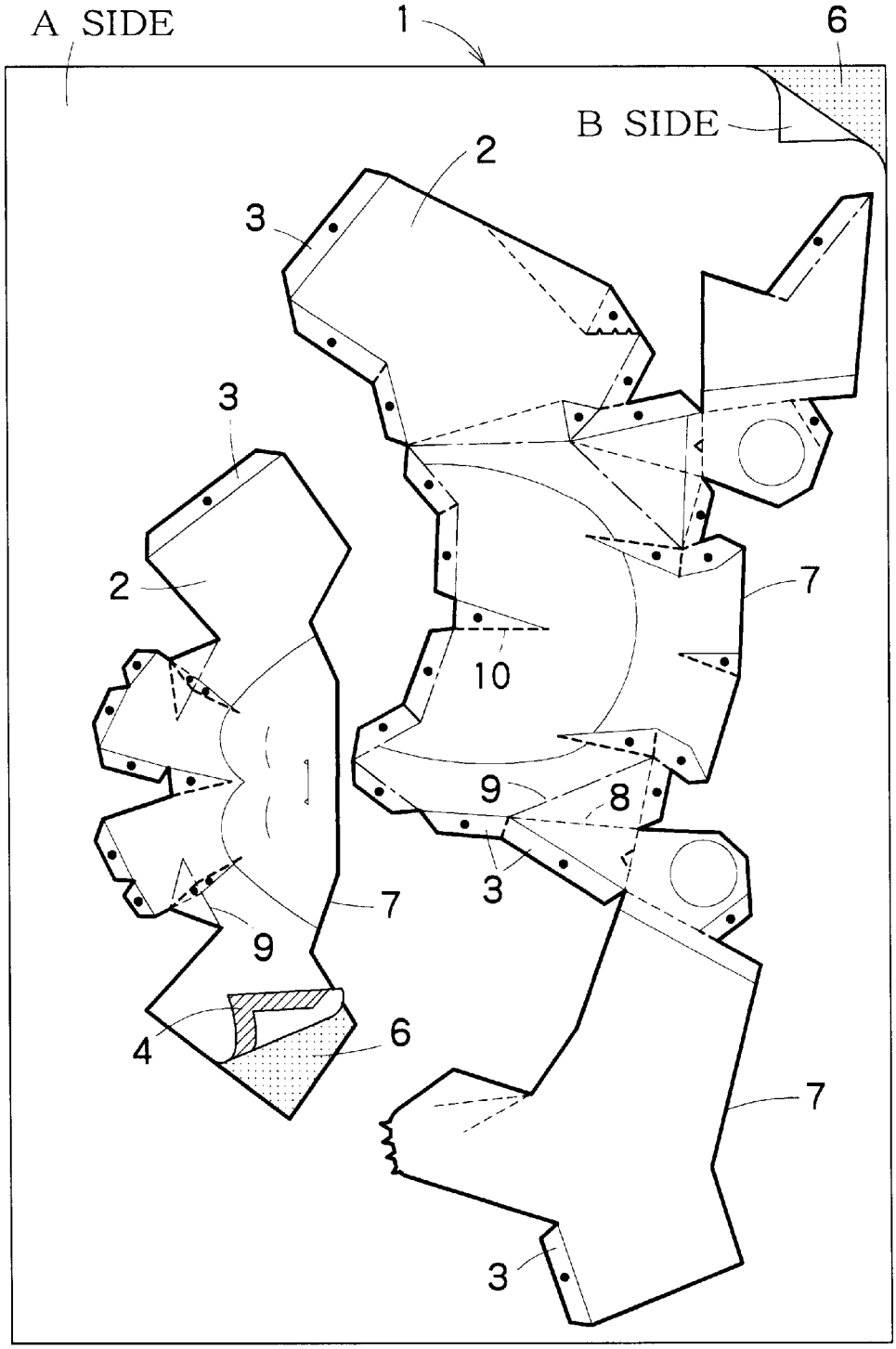
FIG. 1 shows a front surface of a sheet in an embodiment of the papercraft sheet for fabricating a toy according to the invention.

FIG. 1 shows an embodiment of the papercraft sheet 1 for fabricating a toy according to the invention. Explaining the construction, the papercraft sheet 1 is made of a normal paper sheet. On an A side which is the front surface of the papercraft sheet 1 are printed, for example, patterns 2 which are developments of a popular character "KABIGON" in multicolor. On the A side, tabs 3 for sticking are also printed along portions of the outlines of the patterns 2.

Figure 2:
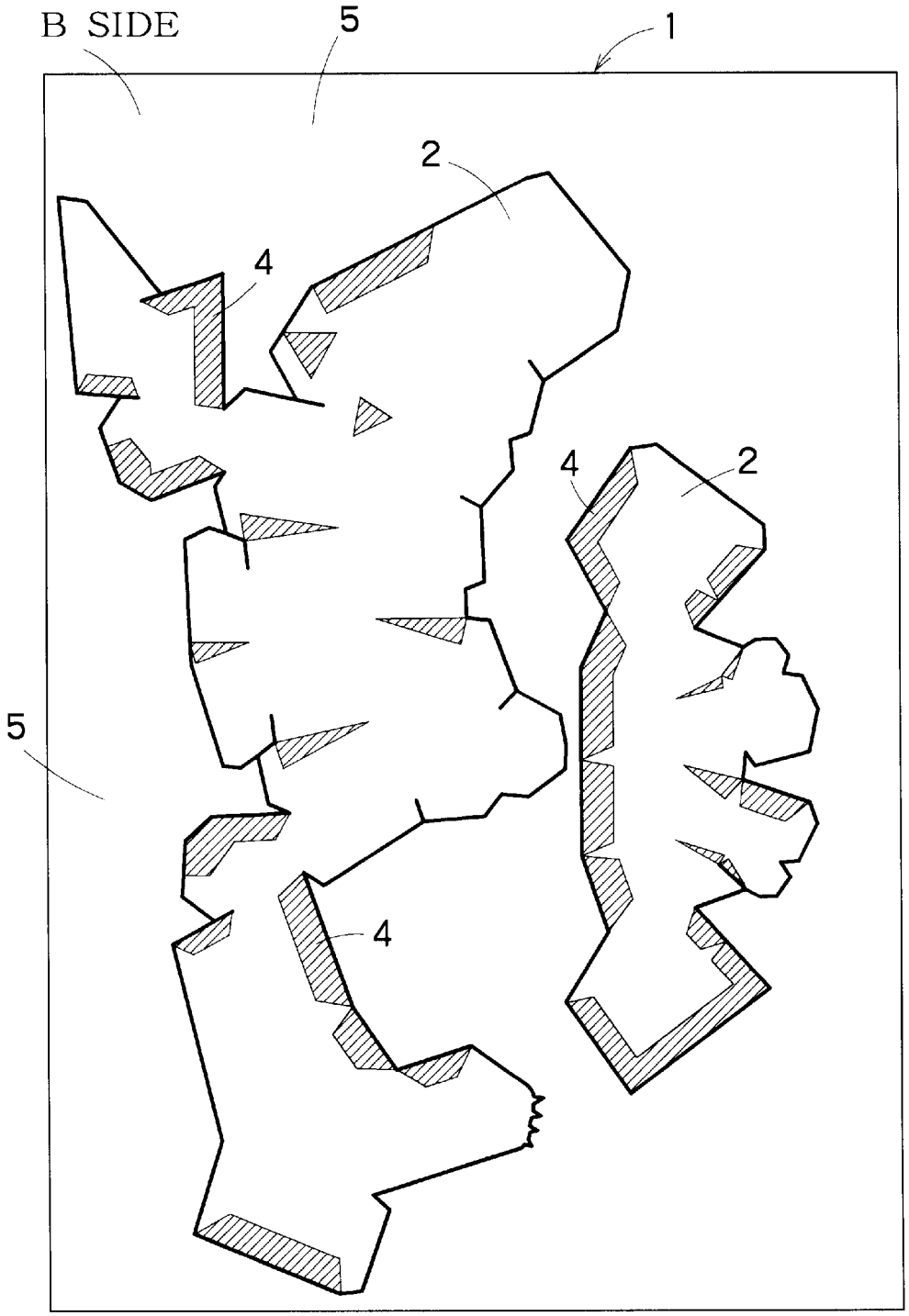
FIG. 2 shows a reverse surface of the sheet of FIG. 1.

FIG. 2 shows a B side of the papercraft sheet 1, which is the reverse surface of the A side shown in FIG. 1. On the B side, a number of sticky surfaces 4 are provided at corresponding portions to which the tabs 3 for sticking on the A side are to be stuck and which are shown by hatching.

In addition, on the B side, the large area outside of the outlines or contours of the patterns 2 and the tabs 3 on the A side is formed into another sticky surface 5. A release sheet 6, whose size is substantially the same as the B side, is stuck to the B side, and the papercraft sheet 1 and the release sheet 6 are united together like a single sheet unless the release sheet 6 is peeled off.

There are two methods for forming the sticky surfaces 4 and 5, which are:

(1) An adhesive effect removing method, which consists of applying a paste on the whole B side and making a treatment to cause the paste to lose the adhesive function except for the sticky surfaces 4 and 5; and

(2) A method of applying a paste locally, which consists of applying the paste to only the desired portions (sticky surfaces 4 and 5).

Both the methods can be used in this invention. According to this feature, when the patterns 2 and the tabs 3 for sticking are peeled off from the release sheet 6 which forms an integral part of the papercraft sheet 1, there are less troubles due to the stickiness, because the sticky surfaces 4 on the reverse sides of the patterns 2 have small areas. Therefore, this papercraft sheet 1 is easy to handle.

The outlines of the patterns 2 and tabs 3 are formed into lines 7 for clipping or cutting. There are also provided lines for folding such as convex folding lines 8 and concave folding lines 9. Lines 10 for a cut are also provided.

The kinds of the lines could be distinguished, for example, in such a manner that lines 7 for clipping are heavy lines, convex folding lines 8 are dotted lines, concave folding lines 9 are dashed lines and lines 10 for a cut are two-dot chain lines. The papercraft sheet 1 for fabricating a toy is configured as above.

The following is a description of how a toy is fabricated from the papercraft sheet 1.

First, the user clips the patterns 2 with the tabs 3 for sticking out of the A side of the papercraft sheet 1 along the lines 7 for clipping. After that, he or she peels the patterns 2 and the tabs 3 from the release sheet 6.

Figure 3:
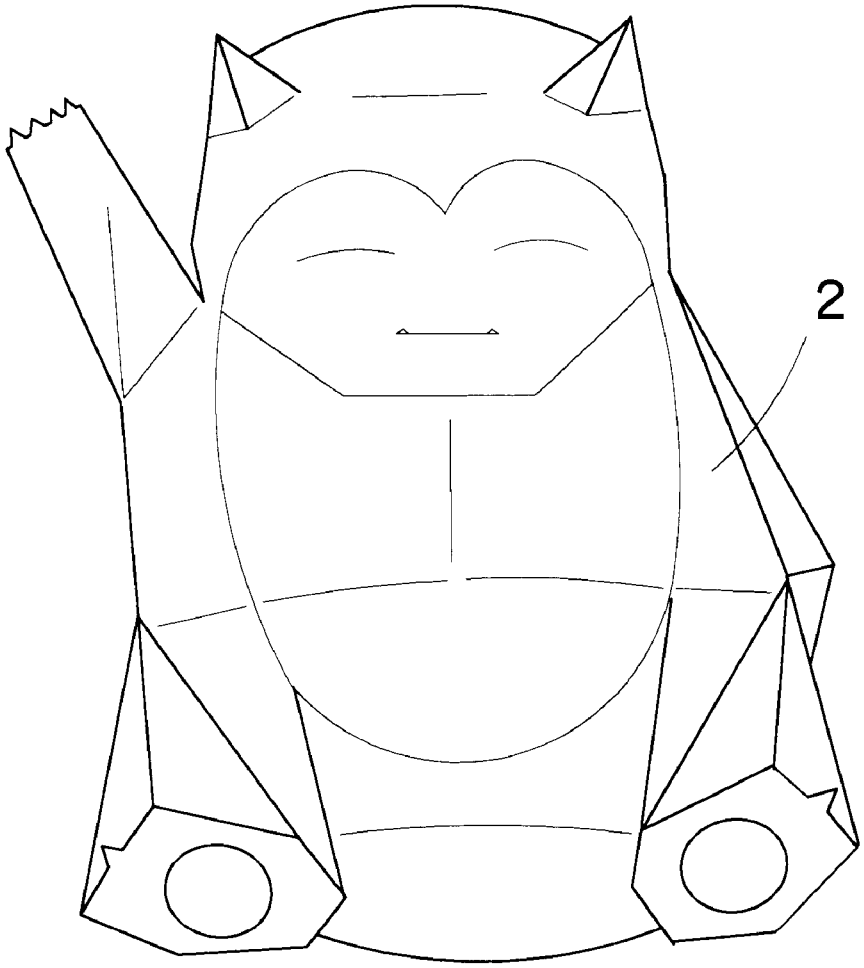
FIG. 3 is a perspective view showing a three-dimensional product fabricated from a papercraft sheet for fabricating a toy according to the invention.

Then he or she folds the patterns 2 along the lines for folding, that is, the convex folding lines 8 and concave folding lines 9. Thereafter, he or she puts together, sticks and fixes the tabs 3 to the corresponding sticky surfaces 4 provided on the reverse sides of the patterns 2, on the B side. Thus, the three-dimensional toy shown in FIG. 3 is fabricated.

Since the sticky surfaces 4 are provided at the desired portions on the reverse side of the patterns 2, the tabs 3 for sticking which are provided along the outlines of the patterns 2 can be stuck directly to the sticky surfaces 4 without any pasting operation. In addition, as the sticky surfaces 4 have small areas, there is a less fear of troubles due to the stickiness than the case in which the whole area of the reverse side of the patterns 2 are made sticky. Consequently, a good finished condition of the fabricated toy can be obtained.

In short, this invention achieves the following advantages:

(1) The fabricating time is shortened to about one third of the time needed for the conventional one.

(2) Even children can easily fabricate a toy from the papercraft sheet.

(3) As any pasting operation is unnecessary, the user's hands are kept clean.

(4) When fabricating, scissors are not necessary, which results in more safety.

(5) As the area of the reverse surface are not wholly sticky, such a trouble that undesired portions other than desired portions glue together and resist to be peeled seldom occurs.

What is claimed is:

1. A sheet for fabricating a three-dimensional toy, comprising:

a sheet having a front surface and a reverse surface, with a pattern printed on at least a portion of the front surface of the sheet, the sheet including a tab disposed at an outside portion of an outline of the pattern, the tab having a front surface and a reverse surface, the front and reverse surfaces of the tab being common with the respective front and reverse surfaces of the sheet;

a sticky surface provided on the reverse surface of the sheet at a location within the outline of the pattern where the front surface of the tab will confront the reverse surface of the sheet when the sheet is assembled in to the three dimensional toy;

a release sheet for protecting the sticky surface, the release sheet having a size substantially the same as said sheet;

a line for clipping provided at the outline of the pattern and the tab; and a line for folding provided in an inside area of the line for dipping;

wherein the pattern and the tab are clipped out of the sheet by clipping along the line for clipping and the sheet is fabricated into said three-dimensional toy by folding along the line for folding with the front surface of the tab being fixedly attached to the reverse surface of the sheet by the sticky surface provided on the reverse side of the sheet.

2. A sheet according to claim 1 wherein an area other than the sticky surface on the reverse surface of the sheet has been treated by an adhesive affect removing method.

3. A sheet according to claim 1 wherein the sticky surface on the reverse surface of the sheet is formed by applying a paste locally.

4. A sheet according to claim 1 wherein said sheet includes a plurality of tabs extending from the outside portion of the outline of the pattern and a corresponding plurality of sticky areas on the reverse side of the sheet, each sticky area providing a sticky surface for adhering the front surface of a corresponding tab to the reverse surface of the sheet when the sheet is fabricated into said three-dimensional toy.

5. A sheet according to claim 1 wherein said sheet includes a plurality of lines for folding the sheet for fabricating the sheet into said three-dimensional toy.

6. A sheet according to claim 5 wherein said plurality of lines including markings on the front surface of the sheet, said markings indicating whether a fold to be made at the fold line is a concave fold or a convex fold relative to the front surface of the sheet.

7. A sheet according to claim 1 wherein said sheet includes a plurality of lines for folding the sheet, at least some of said lines defining folds which are convex relative to the front surface of the sheet and at least others of said fold lines defining folds which are concave relative to the front surface of the sheet for folding the sheet into the three-dimensional toy.

* * * * *

UNITED STATES PATENT AND TRADEMARK OFFICE

CERTIFICATE OF CORRECTION

PATENT NO. : 6,136,400
DATED : October 24, 2000
INVENTOR(S) : Satoshi Katayose et al.

It is certified that error appears in the above-identified patent and that said Letters Patent is hereby corrected as shown below:

Title page,
Item [73], should read: -- [73] Assignee: Shogakukan Inc., Tokyo-To (JP); Jupiter Corporation, Kyoto-Fu (JP) --

Signed and Sealed this

Thirty-first Day of December, 2002

JAMES E. ROGAN
*Director of the United States Patent and Trademark Office*